US010306994B2

(12) United States Patent
Barr et al.

(10) Patent No.: US 10,306,994 B2
(45) Date of Patent: Jun. 4, 2019

(54) ADJUSTABLE FURNITURE

(71) Applicant: MOTUS MECHANICS LTD., Cheltenham (GB)

(72) Inventors: Stephen Allen Barr, Phoenix, AZ (US); Paul Daniel Brown, Lancashire (GB)

(73) Assignee: HHC CHANGZHOU CORPORATION, Changzhou (CN)

( * ) Notice: Subject to any disclaimer, the term of this patent is extended or adjusted under 35 U.S.C. 154(b) by 0 days.

(21) Appl. No.: 15/484,208

(22) Filed: Apr. 11, 2017

(65) Prior Publication Data

US 2017/0295943 A1 Oct. 19, 2017

(30) Foreign Application Priority Data

Apr. 16, 2016 (GB) ..... 1606686.2

(51) Int. Cl.
*A47C 20/04* (2006.01)
*A47C 19/02* (2006.01)
(Continued)

(52) U.S. Cl.
CPC ..... *A47C 20/041* (2013.01); *A47C 19/025* (2013.01); *A47C 19/00* (2013.01);
(Continued)

(58) Field of Classification Search
CPC ... A47C 19/025; A47C 20/041; A47C 19/122; A47C 19/124; A47C 19/126;
(Continued)

(56) References Cited

U.S. PATENT DOCUMENTS 174,487 A * 3/1876 Connor ..... A63B 71/0672 235/124
366,267 A * 7/1887 Stanley, Jr. ..... H02P 7/063 388/816

(Continued)

FOREIGN PATENT DOCUMENTS

| | | |
|---|---|---|
| GB | 2517311 | 2/2015 |
| JP | 2005-28000 | 2/2005 |
| JP | 2010-11890 | 1/2010 |

*Primary Examiner* — Nicholas F Polito
*Assistant Examiner* — Morgan J McClure
(74) *Attorney, Agent, or Firm* — Law Office of Steven W. Weinrieb

(57) ABSTRACT

The invention provides an adjustable bed comprising a frame (20) and at least one adjustable body support section including at least an adjustable backrest support section (12) pivotally mounted for angular adjustment with respect to the frame. The frame comprises at least two hinged sections (20*a*, 20*b*) including a head end sub-assembly configured as an upper body supporting section on which the backrest support section is mounted, and a separate toe end sub-assembly configured as a lower body supporting section hinged with respect to the upper body supporting section. Actuator means (40) is disposed within at least the upper body section for angular adjustment of the adjustable body support section. The head end sub-assembly and the toe end sub-assembly are capable of being folded together to reduce the length dimension of the bed for transportation and/or storage purposes and subsequently unfolded to provide a full length adjustable bed.

3 Claims, 10 Drawing Sheets

(51) Int. Cl.

| | |
|---|---|
| *A47C 19/00* | (2006.01) |
| *A61G 1/00* | (2006.01) |
| *A47C 20/02* | (2006.01) |
| *A47C 20/00* | (2006.01) |
| *A47C 19/12* | (2006.01) |

(52) U.S. Cl.
CPC ..... *A47C 19/122* (2013.01); *A47C 20/00* (2013.01); *A47C 20/02* (2013.01); *A47C 20/04* (2013.01); *A61G 1/00* (2013.01)

(58) Field of Classification Search
CPC ..... A47C 19/021; A47C 19/00; A47C 20/02; A47C 20/04; A47C 20/08; A47C 20/043; A47C 20/00; A47C 17/70; A47C 17/74; A47C 17/76; A61G 1/00; A61G 1/013; A61G 1/06
See application file for complete search history.

(56) References Cited

U.S. PATENT DOCUMENTS 2,390,660 A * 12/1945 Muenzen ..... A47C 1/146 297/377
2,773,269 A * 12/1956 Holt ..... A47C 19/122 5/152
3,634,893 A * 1/1972 Hern ..... A47C 17/17 5/37.1
3,866,250 A * 2/1975 Bradford ..... A47C 20/043 297/364
3,886,610 A * 6/1975 Shelden ..... A61G 7/00 5/727
4,064,574 A * 12/1977 Schnitzler ..... A61G 1/044 297/476
5,090,071 A * 2/1992 Bathrick ..... A47C 19/122 5/174
6,035,467 A * 3/2000 Lee ..... A47C 17/70 5/174
6,076,210 A * 6/2000 Wu ..... A47C 19/122 5/174
6,516,479 B1 * 2/2003 Barbour ..... A47C 19/045 5/152
6,568,008 B2 * 5/2003 Siepmann ..... A61G 13/0018 5/617
7,900,302 B2 * 3/2011 Long ..... A47C 20/08 5/617
8,935,817 B2 * 1/2015 Suh ..... A47C 19/122 5/174
2002/0174487 A1 11/2002 Kramer et al.
2006/0026763 A1 2/2006 Mossbeck
2013/0160297 A1 6/2013 Coleman et al.
2013/0312185 A1 11/2013 Suh
2014/0366267 A1 12/2014 Suh

* cited by examiner

ADJUSTABLE FURNITURE

This invention relates to adjustable beds and in particular concerns adjustable beds having one or more adjustable support sections which can be moved to adjust the configuration of the bed.

Adjustable beds are known, for example, from US2002/0174487 which discloses a hospital bed having adjustable back and thigh sections. The hospital bed of US2002/0174487 comprises a frame having a pair of parallel and spaced apart first and second side frame members; a mattress support deck including an adjustable back section having first and second sides; a fixed seat section located adjacent to the back section and an adjustable thigh section located adjacent to the seat section and movable relative to the seat section, to increase the length of the thigh section, as the thigh section is raised relative to the frame. First and second curved tubes are coupled to respective first and second sides of the back section. A plurality of rollers are coupled to the first and second side frame members, with the rollers being configured to support the first and second curved tubes to permit movement of the curved tubes and the back section relative to the frame. A linear actuator is disposed beneath the back section and coupled to the first and second tubes to move the back section from a horizontal position to an elevated position relative to the frame. Two concentric acruate tubes are provided on each side of the bed which have a radius of curvature centred on a location which emulates the natural hip pivot of a person lying on the mattress of the bed. The tubes are secured between three rollers on each side of the bed. Two rollers are located on a bottom side of the radially outer tube, that is to say radially outwards thereof, and the third roller is located on a top side of the radially inner tube. A pair of cross-members extend between the tubes. The arrangement provides a so called shear-less pivot mechanism in which the adjustable back section pivots about the natural hip point of the person on the bed.

The arrangement disclosed in US2002/0174487 may be considered heavy, robust and mechanically complex. This structure, while suitable for hospital beds, does not readily provide an arrangement that is suitable for more lightly used applications such as domestic furniture, where other design considerations, such as weight and cost and mechanical simplicity, come into play.

One of the drawbacks of domestic adjustable beds is that known arrangements do not readily lend themselves to the logistics of the furniture industry in terms of storage, transportation, shipping, distribution and delivery.

There is a requirement for an adjustable bed which is mechanically less complicated than hitherto known designs and which has attendant weight and cost advantages.

There is a particular requirement for an adjustable bed which is at least as easy to manufacture, store, transport, deliver and assemble as non-adjustable beds of known designs.

According to an aspect of the present invention there is provided an adjustable bed comprising a frame and at least one adjustable body support section including at least an adjustable backrest support section pivotally mounted for angular adjustment with respect to the frame, characterised in that the frame comprises at least two hinged sections including a head end sub-assembly configured as an upper body supporting section on which the backrest support section is mounted, and a separate toe end sub-assembly configured as a lower body supporting section hinged with respect to the upper body supporting section, and actuator means disposed within at least the upper body section for angular adjustment of said at least one adjustable body support section, wherein the head end sub-assembly and the toe end sub-assembly are capable of being folded together to reduce the length dimension of the bed for transportation and/or storage purposes and subsequently unfolded to provide a full length adjustable bed The above aspect of the invention provides a foldable adjustable bed in which the frame is divided into at least two hinged sections, preferably two sections, more preferably two half sections. This assists in storage, transportation, display, delivery and installation. An adjustable bed according to the present invention may therefore be more cost effective to ship due to the reduced length dimension of the bed when packaged for shipping, etc. For example. it is envisaged that up to twice of many beds of the above aspect of the invention could be loaded into an ISO container than conventional non-folding adjustable bed designs, thus reducing transportation and storage costs form the place of manufacture though to delivery to the customers home.

An adjustable bed according to the present invention may be assembled on site by simply unfolding the sections of the frame and placing a suitable mattress on the unfolded frame. For example, a compact package containing the bed may be delivered to a customer's home and readily manoeuvred through standard size doorway and hallway apertures into a bedroom where the bed can be unfolded to end, to provide a full length frame on which a mattress can be placed. This is a significant improvement over hitherto know designs of adjustable beds which typically comprise a kit of parts for assembly at the customer's home. This not only adds to the time of installation, but also requires more skilled labour for delivery and installation. The cost of distribution can be significantly reduced with adjustable beds of the above aspect of the invention, particularly as the bed frame may be transported and delivered as a single item which can be readily deployed for use. It is to be understood that the transportation of such goods by recognised carriers is often charged on a per item basis, hence the present invention also envisages lower distribution costs which has particular advantage in the case of direct sales by ecommerce.

In particular the above aspect of the invention contemplates embodiments without complex and expensive actuating elements. This aspect of the invention can achieve significant weight and cost advantages without compromising performance and durability. This is a particular consideration in the domestic furniture industry where manufacturing cost is often of critical importance to product success in the marketplace. A significant advantage of this aspect of the present invention is that the profile of the bed, that is to say the depth dimension of the bed, can be minimised, and thereby a low profile adjustable bed can be realised with attendant storage and shipping cost advantages. Particularly when compared with hitherto known designs, due to a smaller depth dimension of the bed and actuation system. In this respect it will be understood that the depth dimension for shipping purposes is the depth of the bed minus legs or other support means which are shipped unassembled. Thus the reduced depth dimension readily enables greater number of units to be shipped in a given space, such as an ISO container or the like.

The upper body section may further comprise a fixed support section adjacent to the backrest support section, the fixed support section being fixed in relation to the frame adjacent the hinged end of the backrest section to provide at least part of a fixed seat section of the bed.

The lower body section may further comprise a lower body fixed support section adjacent to the upper body section.

The upper body fixed support section is preferably hingedly connected to the lower body fixed support section.

The lower body section of the frame may be non-adjustable

The upper and lower hinged body sections of the frame may comprise two separate hinged half sections of the frame.

The adjustable bed may further comprise locking means for locking the respective upper and lower hinged body sections of the frame together when the bed is unfolded for use.

An embodiment of the present invention will now be more particularly described, by way of example only, with reference to the accompanying drawings; in which.

Figure 1:
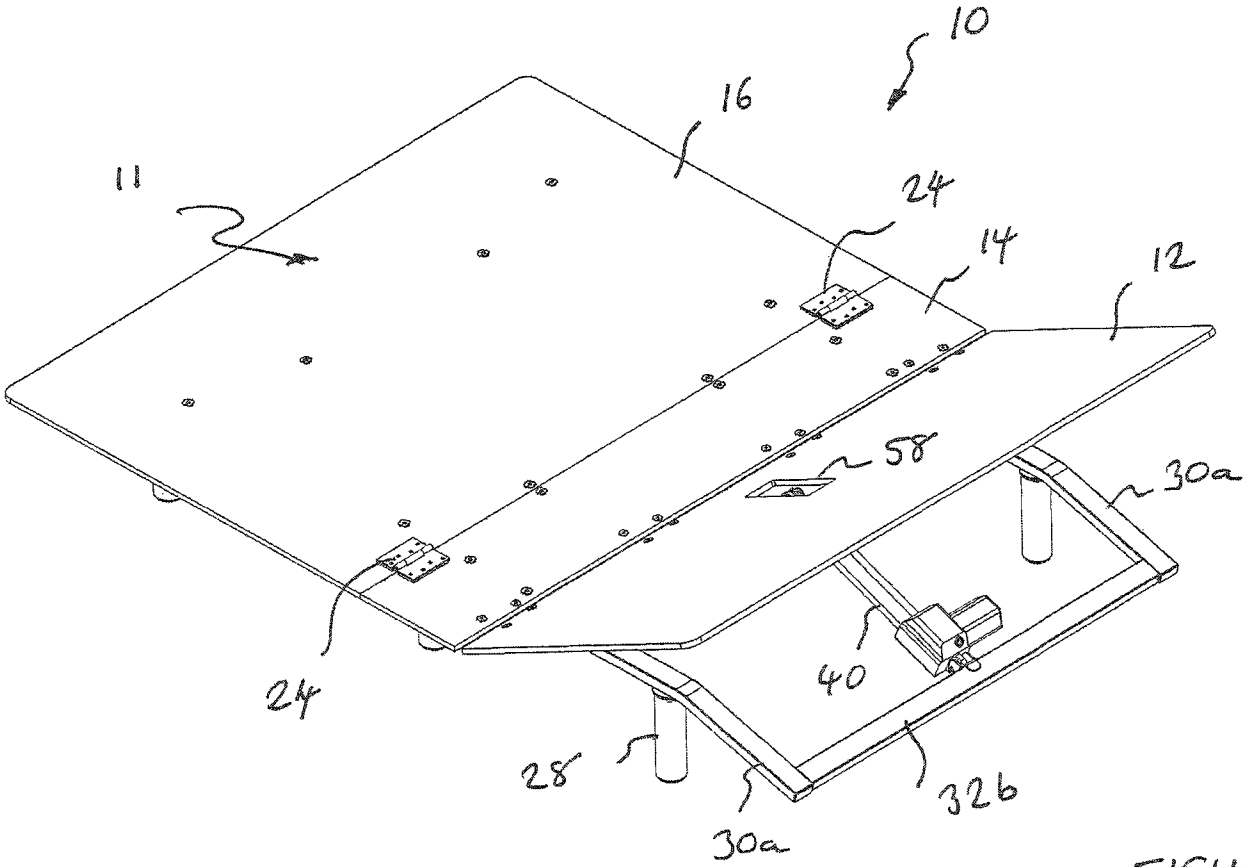
FIG. 1 is a perspective view from above and the rear, left hand side rear quarter, of a frame and operating mechanism of an adjustable bed according to an embodiment of the present invention, with the bed in a semi-upright configuration for supporting an occupant in a seated position.
Figure 2:
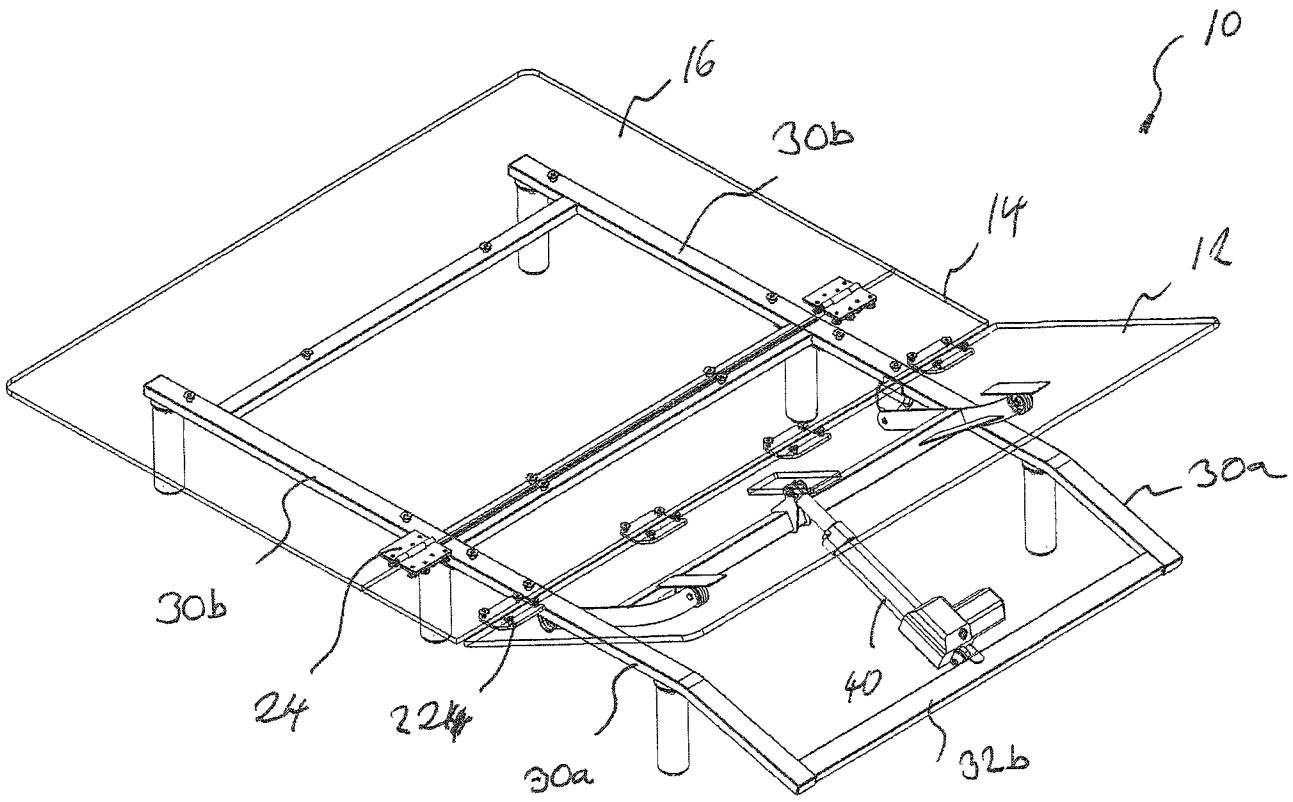
FIG. 2 is the same as FIG. 2 with the mattress support deck shown in ghost outline.
Figure 3:
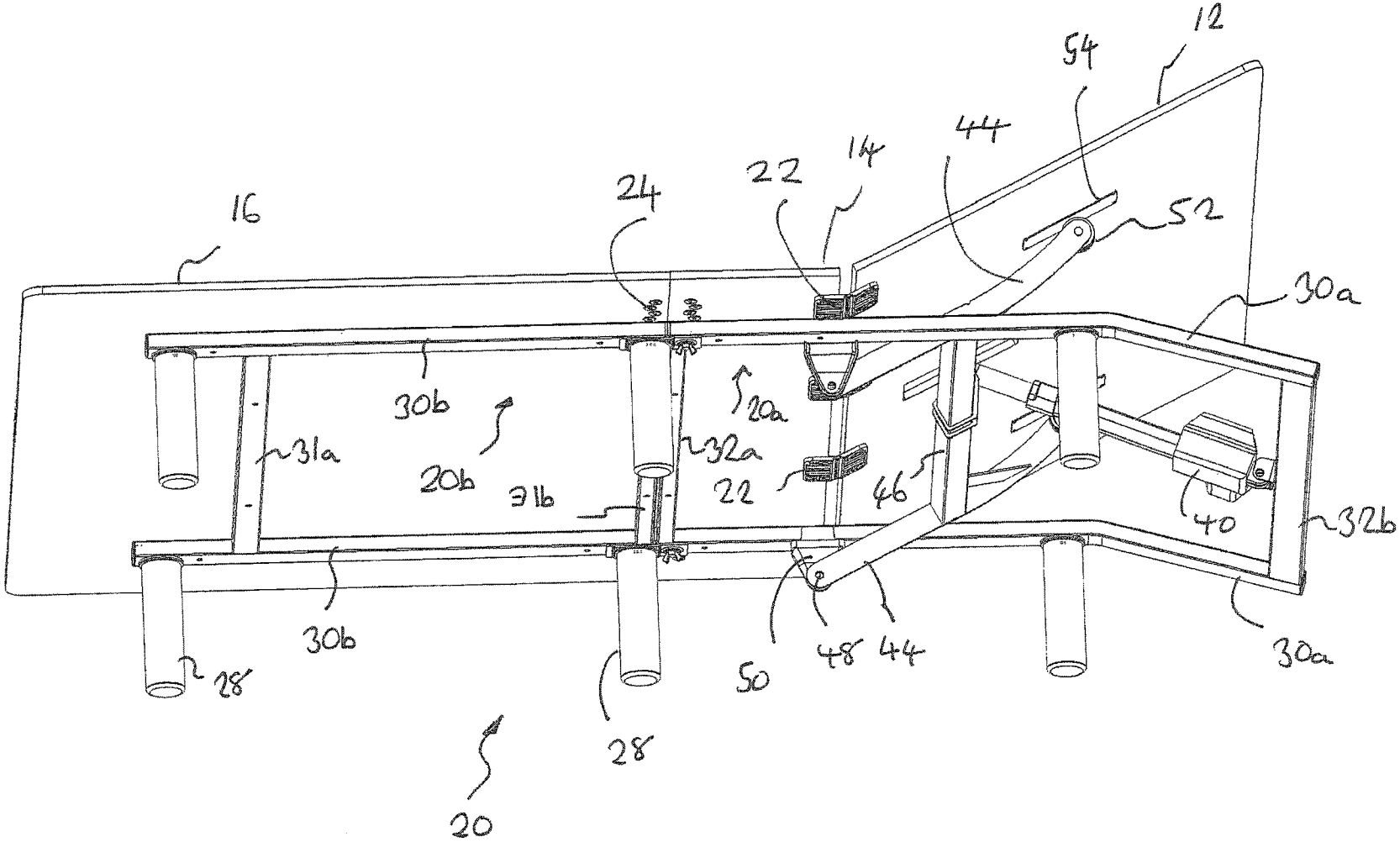
FIG. 3 is a perspective view of the bed of FIG. 1 with the bed viewed from below.
Figure 4:
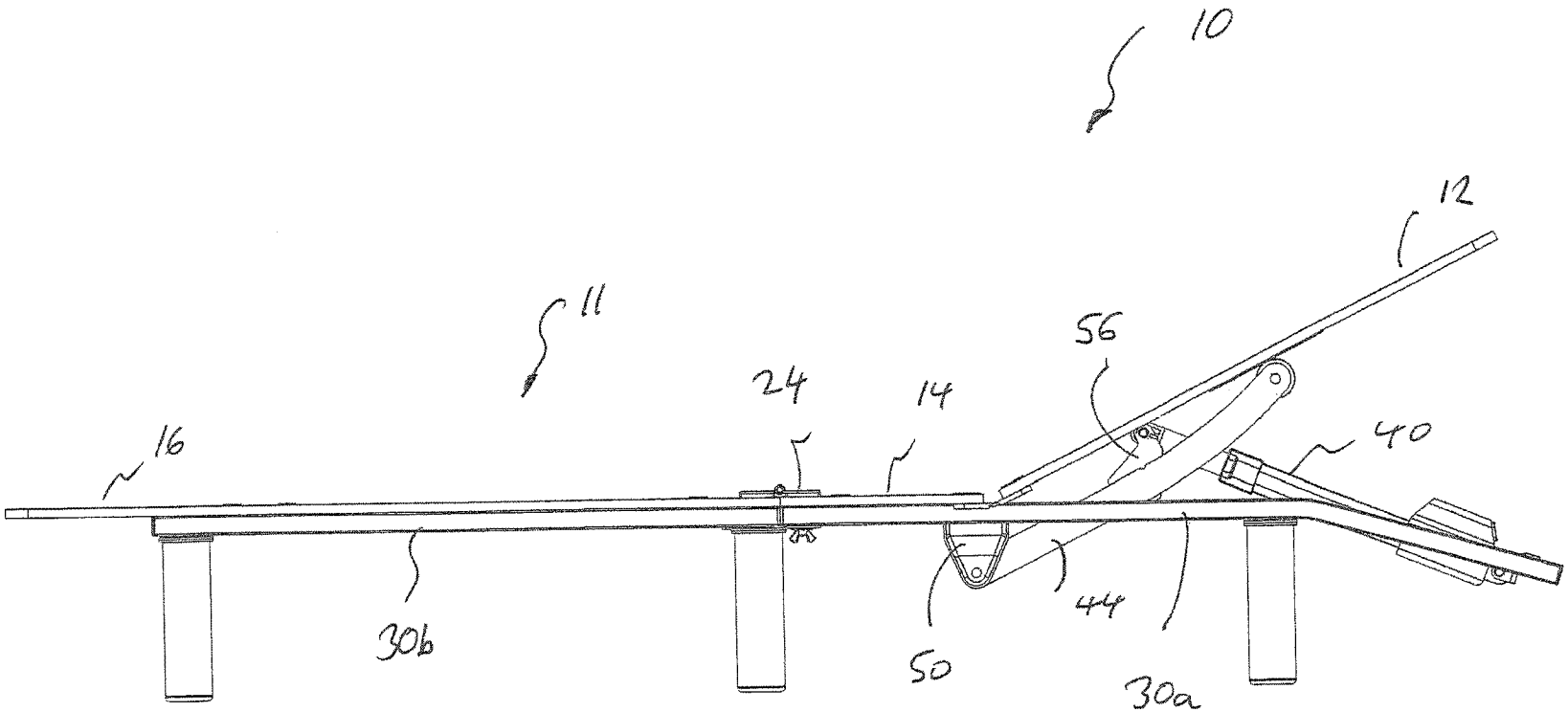
Figure 5:
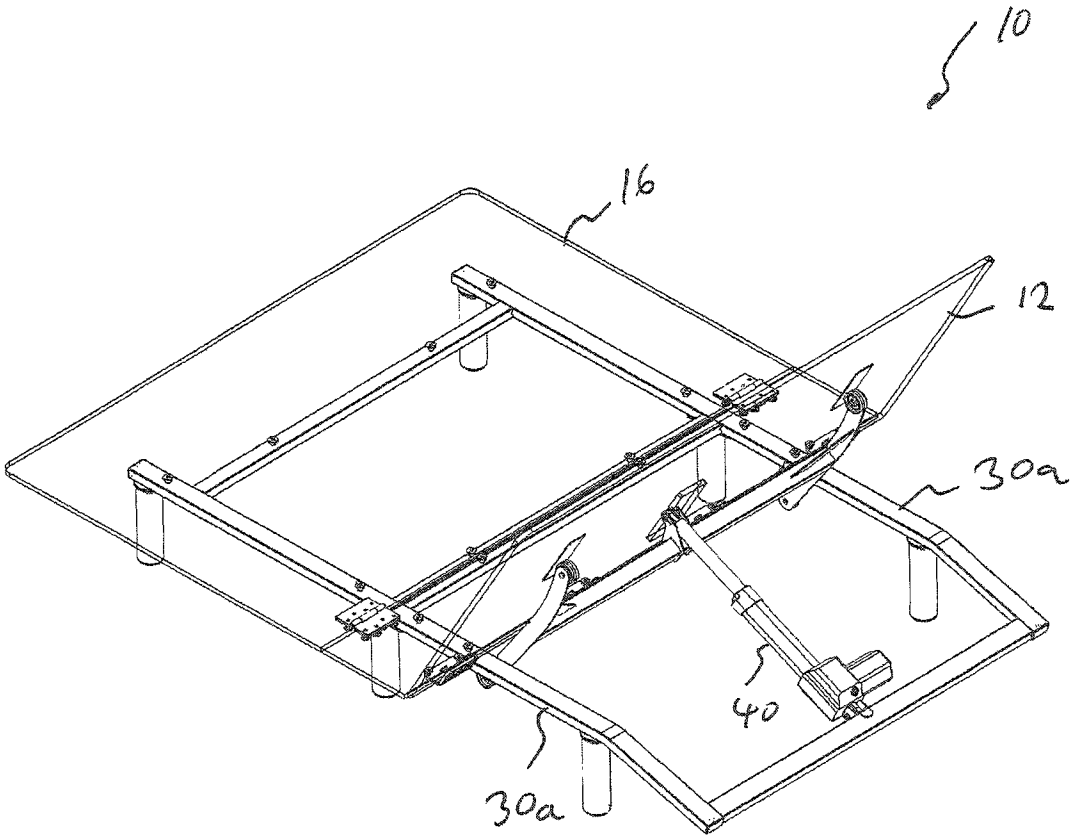
Figure 6:
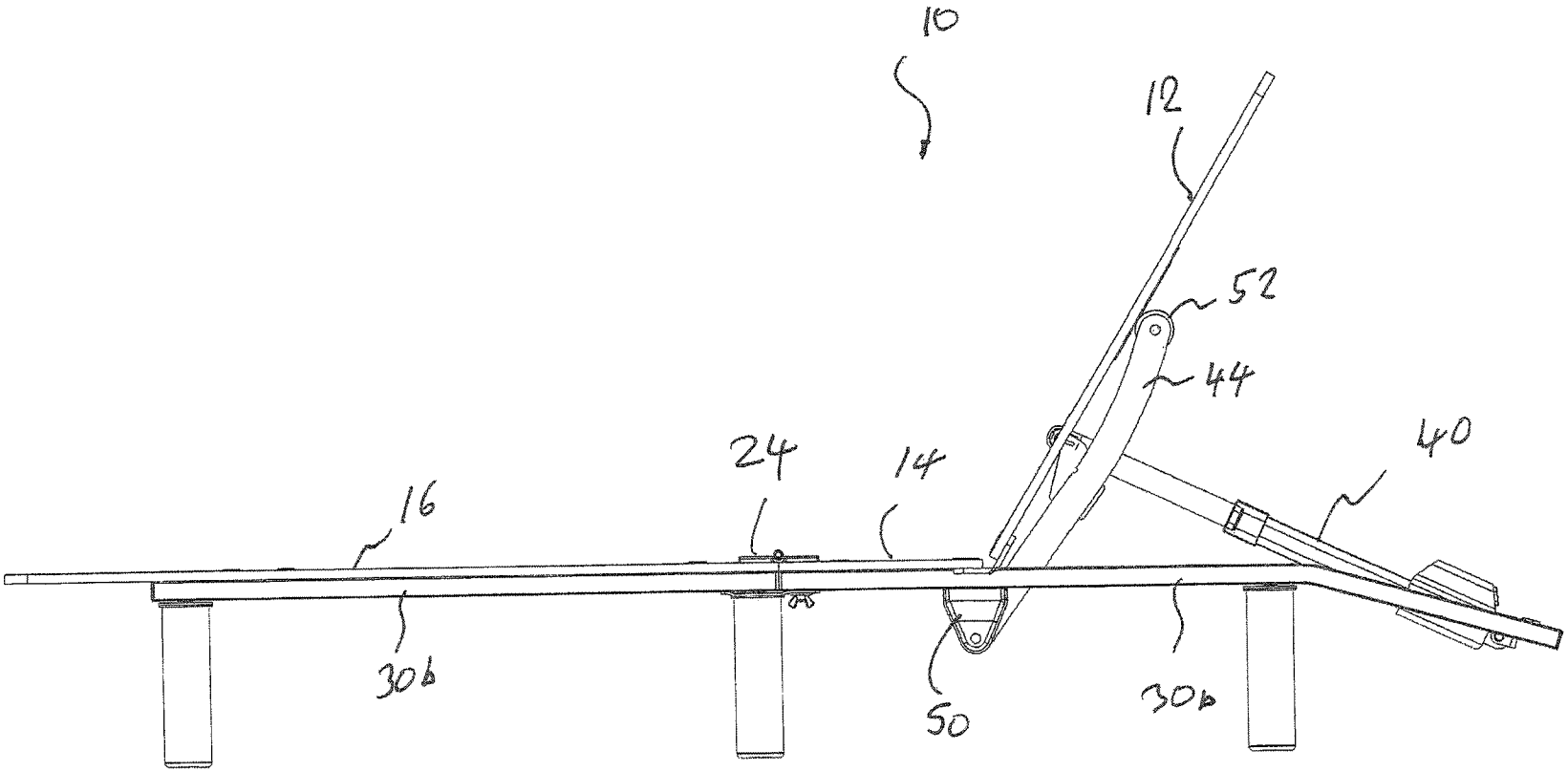
Figure 7:
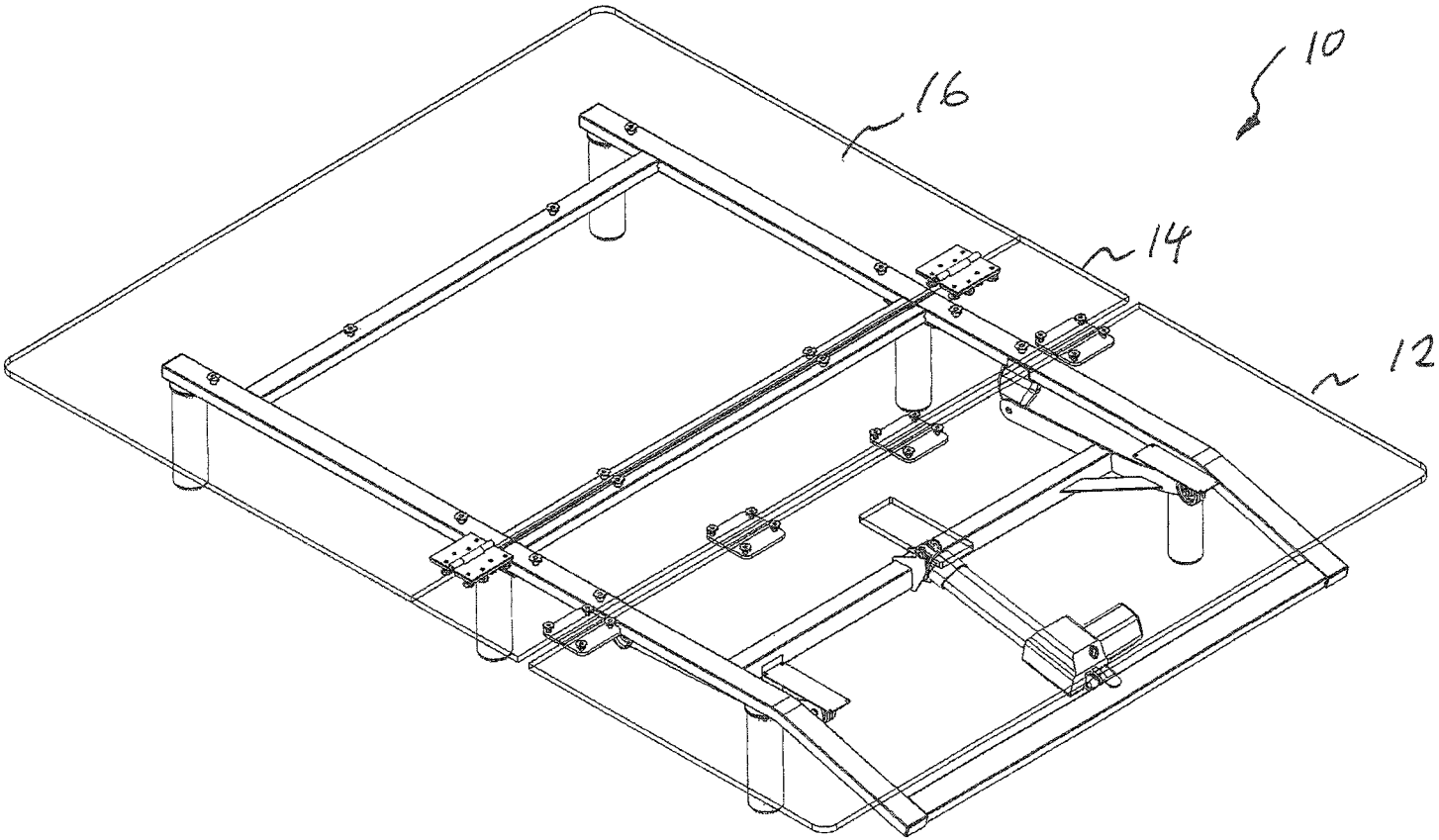
Figure 8:
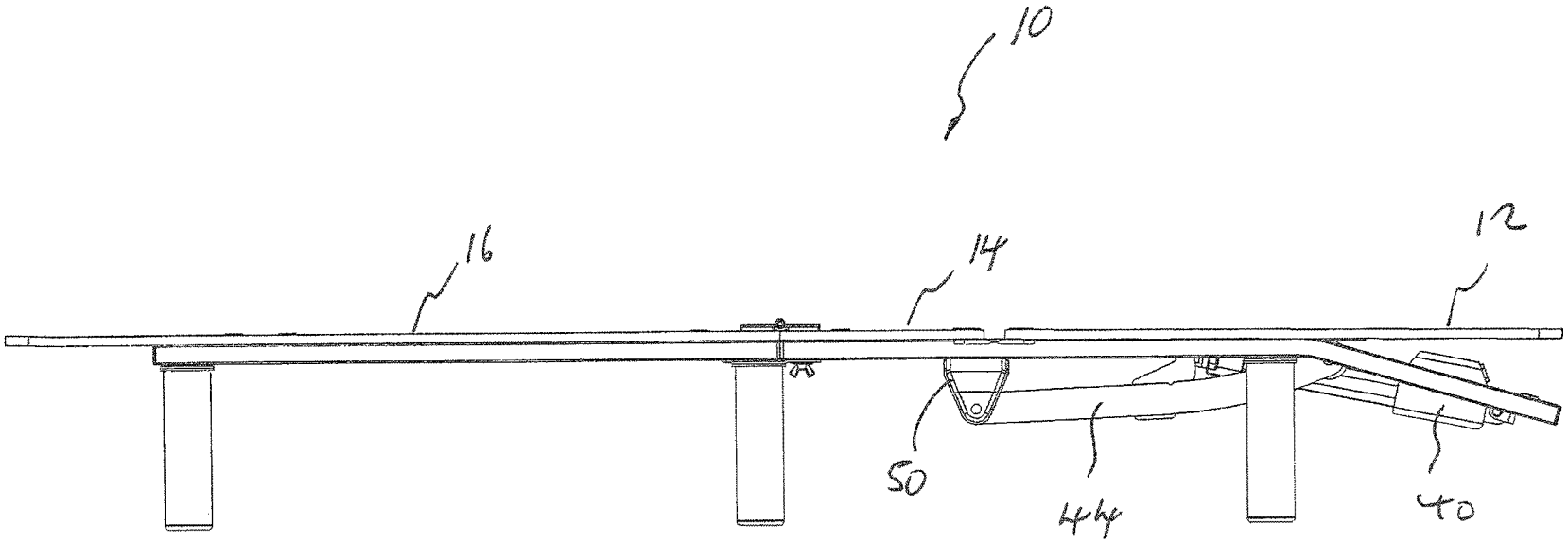
Figure 9:
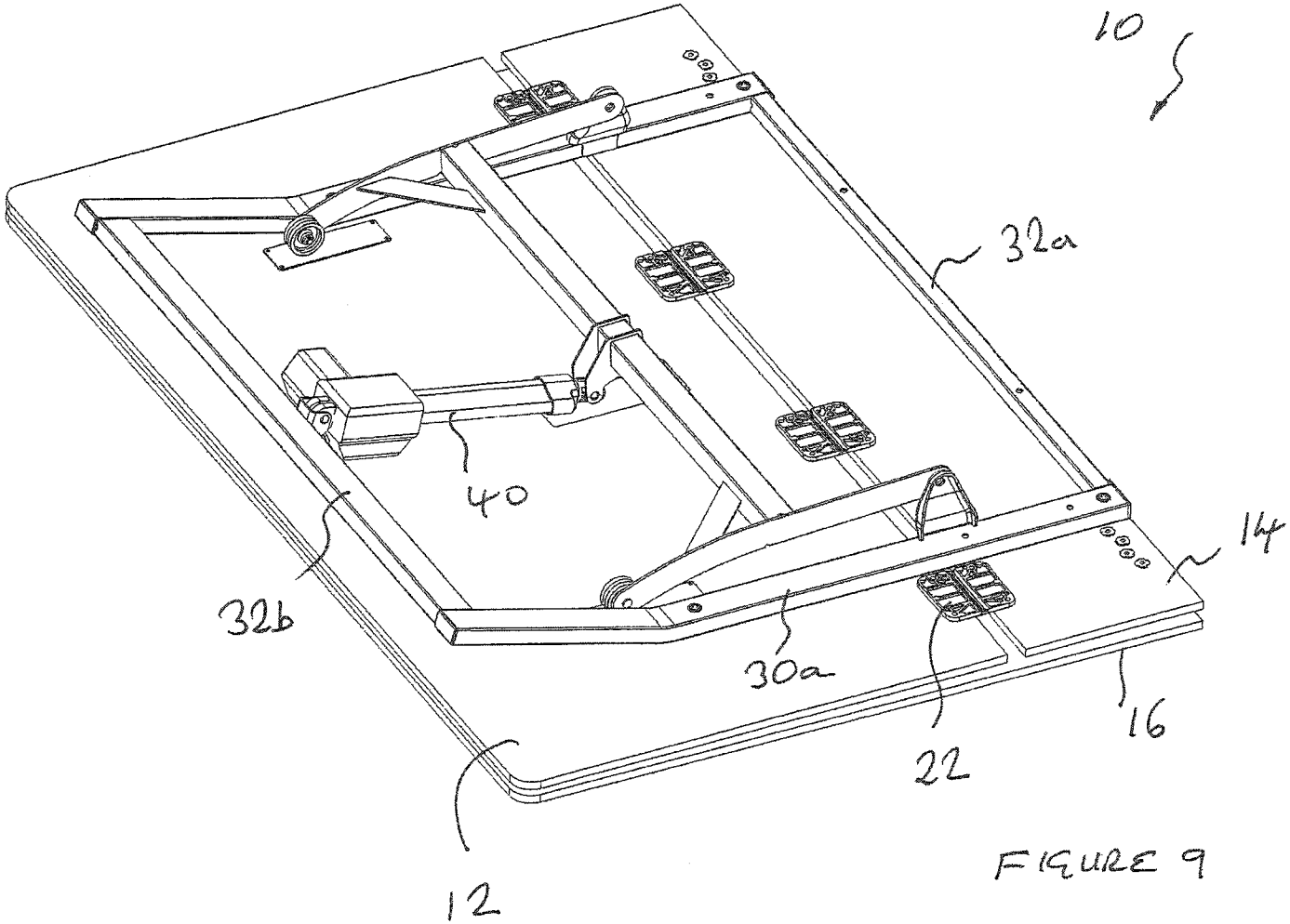
Figure 10:
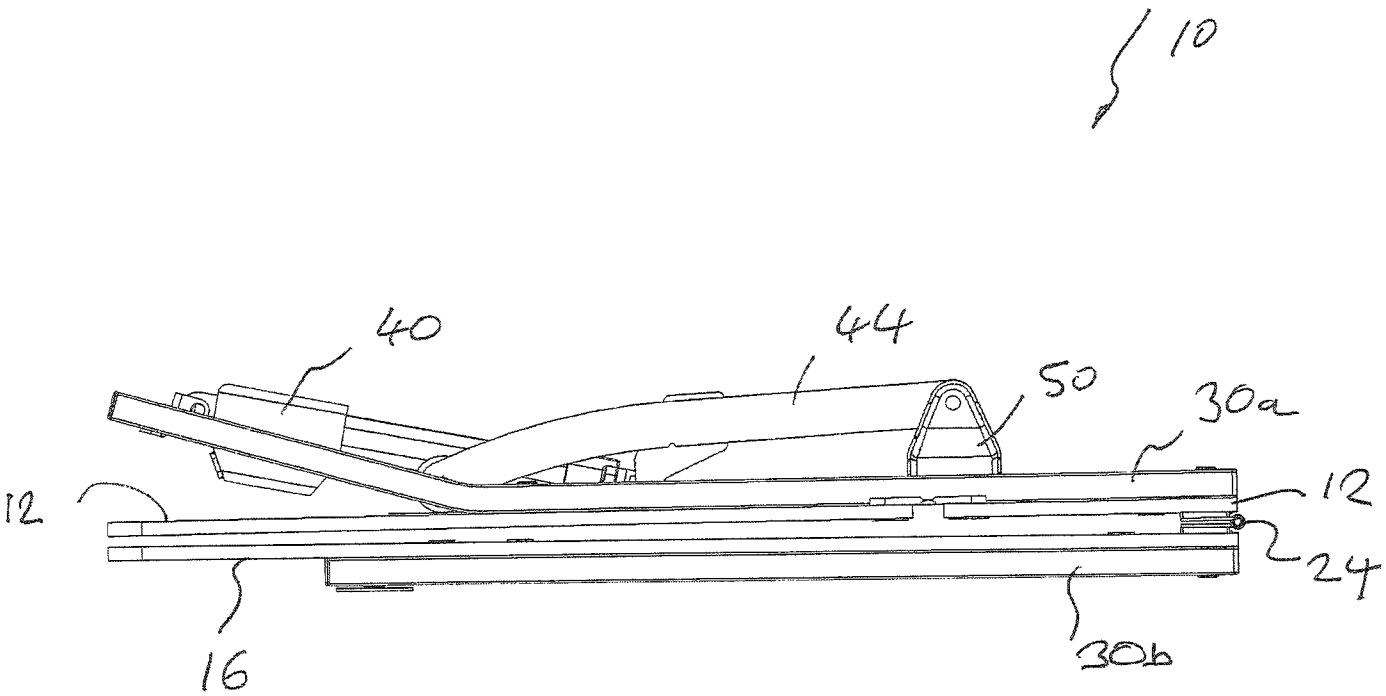

FIG. 4 a side elevation view of the bed of FIG. 1, with the bed in the semi-upright adjusted position of FIG. 1;

FIG. 5 is a perspective view similar to FIG. 2 with the bed in a fully upright adjusted position, with the mattress support deck also shown in ghost outline;

FIG. 6 a side elevation view of the bed similar to FIG. 4, with the bed in the fully upright adjusted position of FIG. 5;

FIG. 7 is a perspective view similar to FIG. 2 with the bed in a fully lowered position, with the mattress support deck also shown in ghost outline;

FIG. 8 a side elevation view of the bed, with the bed in the fully lowered position of FIG. 7;

FIG. 9 is a perspective view of the bed of FIG. 1 with the bed viewed from above with the frame folded along a transverse hinge line;

FIG. 10 a side elevation view of the bed of Figure in the folded configuration of FIG. 9.

Referring to the drawings, FIGS. 1 to 10 schematically show an adjustable bed 10 according to an embodiment of the present invention. The bed 10 comprises a mattress support deck 11 having three adjacent planar mattress support panels, including an adjustable back, neck and head (upper body) support section panel 12, a non-adjustable intermediate support section panel 14 and a non-adjustable lower body support section panel 16. Throughout the drawings of FIGS. 2, 5, and 7 the panels 12, 14, and 16 are shown in ghost outline in order to reveal the detailed construction of the adjustable bed 10.

The panels 12, 14 and 16 are mounted on a support frame 20. The upper body support panel 12 is adjustably mounted on the support frame 20. The intermediate and lower body panels 14 and 16 are fixed in relation to the frame 20.

The frame 20 comprises two half sections hinged together at their respective adjacent ends. The two half sections include a head end sub-assembly 20*a* and a toe end sub-assembly 20*b*. The two half sections 20*a*, 20*b* are hinged together at their respective adjacent ends by hinges 24 fixed to the upward facing surface of the panels 14 and 16 at their respective adjacent edges, as can best be seen in FIGS. 1 and 10. The hinge arrangement is such that the two half sub-assemblies provide a full length structural support frame when hinged apart and locked into position, as shown in the drawings of FIGS. 1 to 8. The hinged sub-assemblies 20*a*, 20*b* allow the upper and lower halves of bed to be folded onto one another, as will be described in greater details below, for transportation, storage, distribution and delivery purposes.

The upper body support panel 12 is adjustably mounted on the head end support frame sub-assembly 20*a*. The intermediate support panel 14 is fixedly mounted on the head end support frame sub-assembly 20*a*, adjacent to the upper body support panel 14. The lower body panel 16 is fixed in relation to the toe end support frame sub-assembly 20*b* adjacent to the intermediate panel 14.

In FIGS. 5 and 6 the bed 10 is shown in a fully articulated configuration, adjusted for supporting an occupant in a raised upright seated position. In this position the upper body support section panel 12 is raised about, and inclined with respect to, the fixed intermediate support section panel 14 about a pivot axis defined by a plurality of hinges 22. Hinges 22 pivotally connect the upper body support section panel 12 to the fixed intermediate support section panel 16 along the respective adjacent edges of the panels.

Hinges 22 may be conventional pin bracket type hinges or, in other embodiments, constructed of a fatigue resistant plastics material as a so called "living hinge". Other types of hinge are also contemplated including extruded metal tubes, for example extruded aluminium or aluminium alloy, having a d or p shape cross-section, including a longitudinal mounting flange as an integral part of the extrusion, where a hinge pin passes through the extruded tube in a known manner and optionally mounted on bearings (ball bearing type) located at the respective ends of the tube to support the hinge pin in a low friction manner. In preferred embodiments the hinges 22 are provided with limited angular adjustment so that the adjustable panel has a limited angular adjustment. The hinges may, for example, be provided with an adjustment stop so that the panel 12 may be raised by a pre-determined maximum amount about their respective pivot axis during adjustment of the bed, for example 60 degrees from the horizontal plane as defined by the other panels 14 and 16.

The present invention also contemplates embodiments (not shown) where the lower body support section 16 is also adjustable, that is to say, articulated with respect to the frame 20. Embodiments of the present invention may therefore provide a bed having an adjustable upper body section only so that the backrest may be raised to lift the occupant to a seated position, or a bed additionally having an adjustable lower body support section 16, which may comprise one or more adjustable and non-adjustable mattress support panels as is well known in the art.

In the lowered position (FIGS. 7 and 8) the adjustable support panel 12 combines with the fixed panels 14 and 16 to define a substantially flat planar horizontal mattress support platform or deck. The various support panels 12-16 may each have a mattress support cushion (not shown) of pre-determined thickness, which combine to provide a mattress foundation for supporting a suitable mattress. Alternatively, a mattress may be positioned directly on top of the panels 12-16. The panels 12-16 may be upholstered, with or without support cushions. The present invention also contemplates arrangements where the frame 10 is configured to be placed within the internal space of a bed surround, for example of the type common in North America, or integrated in a divan type bed foundation structure, more typically found in the United Kingdom. In the illustrated embodiment the bed frame 20 is provided with floor standing legs 28 and is thus self-supporting. Thus, the present invention also contemplates arrangements where the frame 10 is arranged to be positioned within a separate surrounding structure, for example a decorative wood or upholstered surround including head and toe boards and lateral side panels between the head and toe boards. The dimensions of the bed are such that the bed has the size of a double bed, but the present invention contemplates beds of many different widths including standard single size beds to much larger doubles.

The half frame sub-assemblies 20*a* and 20*b* each comprises a generally rectangular structural support frame, preferably constructed of metal but other materials may be used for various component parts, in addition to or instead of metal, including board type material, for example engineering plastic, MDF, timber or other fibre type board for example.

The two half sections 20*a* and 20*b* each comprise a pair of elongate parallel lateral side frame members in the form of respective side rails 30*a*, 30*b*. The side frame members extend longitudinally along the length of the bed on both sides thereof and are joined together at their respective ends by metal, preferably steel, cross-members 31*a*, 31*b*, 32*a*, 32*b* to form rectangular box type structural support frames 20*a*, 20*b*.

The side frame members 30*a*, 30*b* are constructed of suitably dimensioned box section metal tube, preferably steel, and the cross-members 31*a* and 32*b* of similar rectangular box section metal tube. The frame 20 is provided with legs 28 towards each of the corners of the rectangular frame structure and at an intermediate position at the end of the toe end sub-assembly 20*b*. The side members 30*a*, 30*b* and respective cross-members 31*a*, 31*b* and 32*a*, 32*b* are joined together by welding or alternatively by fixing means such as screws, bolts, fasteners or the like. In preferred embodiments the legs are attachably/detachably fixed to the frame by suitable reversible fixing means as are well known in the art, for example screw thread fittings.

The two half sub-assemblies 20*a* and 20*b* are provided with locking means for locking the frame members 30*a*, 30*b* together when the frame 20 is unfolded. The locking means comprises a metal plate 33 secured on the underside of the respective side frame members 30*b* in the region of the hinged connection 24. The metal plate extends over the underside of the adjacent side frame member 30*a* and is attachably/detachably fixed thereto by suitable reversible fixing means, as are well known in the art, for example screw thread fittings, such as a butterfly or winged nut/bolt connection 35 as in the illustrated embodiment.

The unfolded and locked support frame 20 constitutes a floor standing base of the bed 10. The frame 20 may stand directly on legs 28 or alternatively be provided with castors, feet or the like at the end of the legs, as is well known in the art.

Movement of the adjustable panel 12 is effected by means of a powered actuation mechanism comprising a linear actuator 40 and a pivotal "H-frame" 42. The H-frame 42 comprises a pair of arms 44 and a cross-member 46 extending between and connecting the arms 44 approximately midway along their length. The H-frame is pivotally mounted on the underside of the head end sub-assembly frame 20*a* at pivot points 48 at the apex of triangular shaped brackets 50 depending from the underside of the frame 20*a* in the region of hinges 22. The arms 44 are generally straight but curve upwards at their distal end where a roller in the form of a bearing 52 is rotatably mounted. The bearings 52 contact the underside of the panel 12 along wear resistant strips 54 which may be of metal, nylon or the like, along which the bearings 52 run when the panel 12 is lowered and raised.

Actuator 40 is a linear actuator of the Delta-drive type as produced by Dewert-Okin GmbH, having a first end (motor and gear box end) pivotally mounted to the cross-member 32*b* and a second end (rod) pivotally connected to a bracket 56 secured to the cross-member 46. The bracket 56 is configured such that the connection between the output rod of the actuator and the bracket 56 is in the plane of the panel 12. This is achieved by means of a cut-out 58 in the panel 12 through which the bracket 56 and end of the output rod of the actuator extend. The gearbox and motor end of the actuator 40 is connected to the cross-member 32*b* at a position midway along its length. The cross-member 32*b* is located in a plane lower than the general or notional plane of the frame 20 due to the downwardly canted end of the frame 20*a*. The side members 30*a* are inclined downwards along the final third of their length from a position immediately rearward of the legs 28 attached to the frame 20*a*. The side members are inclined downwards approximately 20 degrees or so, so that the connection point between the actuator 40 and the frame 20*a* is below and offset from the notional plane of the frame 20. This arrangement ensures the actuator is also inclined with respect to the notional plane of the frame and the plane of the panel 12 when the panel 12 is in its lowered position (FIGS. 7 and 8). In combination with the other end of the actuator being in the plane of the panel 12, by means of the bracket 56 and cut out 58, the actuator is able to apply a significant initial force to the panel 12 when the panel is to be raised from is lowered position of FIGS. 7 and 8. It is to be understood that the force component acting on the panel 12 when movement is initiated from its lowered position is dependent on the angular orientation of the actuator force vector with respect to the panel 12. In arrangements where the actuator 12 is oriented more or less horizontal with respect to the panel significant initial force is required to move the panel and any load supported by the panel from its lowered position due to poor leverage, compared with the arrangement of the illustrated embodiment where the component of the actuator force initially acting on the panel is greater due to its relative inclination to the panel 12.

Rotational movement of the panel 12 is thus effected by activation of linear electrical actuator 40 positioned on the underside of the bed within the space envelope of the frame. Thus, panel 12 is raised and lowered by respective extension and retraction of actuator 40. In operation, in the fully lowered configuration of the bed, the adjustable panel 12 lies flat on the side rails 30*a*, with the output rod of actuator 40 fully retracted towards the respective gearbox end of the actuator. This position is shown in FIGS. 7 and 8. In order to raise the panel 12, the output rod of the actuator 40 is extended away from the gearbox end of the actuator.

The frame 20 is manually folded and unfolded about the traverse hinge axis defined by the hinge elements 24. Either the head end or toe end frame is moved so that the two half sections of the frame are brought together by relative movement about the hinge axis as shown in FIGS. 9 and 10 where the panels 12 and 14 lie flat on top of the panel 16. As can be seen in FIGS. 9 and 10 when the legs 28 are unattached the adjustable bed 10 has a very small space envelope, with half the length dimension of the unfolded bed in exchange for a modest increase in depth, approximately the additional depth of the toe end half frame.

It will be understood that while the illustrated embodiment of FIGS. 1 to 10 concerns a bed having an adjustable upper body support, the present invention also contemplates embodiments wherein the bed comprises additional adjustable panels for different adjustment configurations, for example including lower body/leg support adjustment for supporting the occupant in a recumbent position.

The invention claimed is:

1. An adjustable bed, comprising:

a frame;

a pair of frame sections including a first head end sub-assembly frame section configured as an upper body supporting section upon which an adjustable backrest support panel and a non-adjustable intermediate body support panel are mounted upon upper surface portions of said first head end sub-assembly frame section, and a second toe end sub-assembly frame section configured as a lower body supporting section upon which a lower body support panel is mounted upon an upper surface portion of said second toe end sub-assembly frame section;

a hinge mechanism having a first hinge plate fixedly secured to said non-adjustable intermediate body support panel of said first head end sub-assembly frame section and a second hinge plate fixedly secured to said lower body support panel of said second toe end sub-assembly frame section such that said first head end sub-assembly frame section and said second toe end sub-assembly frame section are hingedly connected directly to each other around a single hinge axis whereby said first head end sub-assembly frame section and said second toe end sub-assembly frame section are capable of being folded toward each other so as to attain a folded state, with said upper surface portion of said first head end sub-assembly frame section and said upper surface portion of said second toe end sub-assembly frame section being disposed in a face-to-face oppositely disposed relationship with respect to each other so as to minimize the length dimension of said bed, or the width dimension or profile of said bed as considered when said bed is disposed in said folded state, for transportation and/or storage purposes, and subsequently capable of being unfolded away from each other so as to again provide a full length adjustable bed;

said adjustable backrest support section, disposed upon said first upper head end sub-assembly frame section, is pivotally mounted upon said first head end sub-assembly frame section for angular movement with respect to said first head end sub-assembly frame section;

an actuator is operatively connected to said adjustable backrest support section so as to pivotally adjust said adjustable backrest support section to various different angular positions with respect to said first head end sub-assembly frame section;

wherein said first head end sub-assembly frame section and said second toe end sub-assembly frame section are disposed within a horizontal plane when said first head end sub-assembly frame section and said second toe end sub-assembly frame section are unfolded away from each other so as to again provide a full length adjustable bed; and said first head end sub-assembly frame section comprises a frame segment which is inclined downwardly, relative to said horizontal plane within which said first head end sub-assembly frame section and said second toe end sub-assembly frame section are disposed when said first head end sub-assembly frame section and said second toe end sub-assembly frame section are unfolded away from each other so as to again provide a full length adjustable bed, and to which one end of said actuator is attached such that said actuator is always disposed beneath said adjustable backrest support section so as to therefore be capable of applying an upwardly inclined force in order to move said adjustable backrest support section between fully lowered and fully raised positions.

2. An adjustable bed as claimed in claim 1 wherein said non-adjustable intermediate body support panel serves to provide at least part of a fixed seat section of the bed.

3. An adjustable bed as claimed in claim 2 wherein said lower body support panel of said second toe end sub-assembly frame section is non-adjustable.

* * * * *